United States Patent [19]

Quirouette et al.

[11] 3,934,277

[45] Jan. 27, 1976

[54] PORTABLE SWIMMING POOL CONSTRUCTION

[76] Inventors: Richard L. Quirouette, 197 Presland Road, Ottawa, Ontario, Canada, KIK 2B9; Rejean P. Lemay, 2250 Notre Dame Blvd., Orleans, Ontario, Canada

[22] Filed: Apr. 8, 1974

[21] Appl. No.: 458,994

[52] U.S. Cl. ..... 4/172.19; 52/169

[51] Int. Cl.[2]... E04H 3/16; E04H 3/18; F16L 21/02

[58] Field of Search ..... 4/172, 172.19; 52/169

[56] References Cited

UNITED STATES PATENTS

| | | | |
|---|---|---|---|
| 2,846,694 | 8/1958 | Wallace | 4/172.19 |
| 2,939,153 | 6/1960 | Arnold et al. | 4/172.19 |
| 3,193,847 | 7/1965 | Mashura | 4/172.19 |
| 3,268,917 | 8/1966 | Diemond et al. | 4/172.19 |
| 3,274,621 | 9/1966 | Diemond et al. | 4/172.19 |
| 3,428,969 | 2/1969 | Diemond et al. | 4/172.19 |
| 3,445,866 | 5/1969 | Shields | 4/172.19 |
| 3,736,599 | 6/1973 | Kesslar et al. | 4/172.19 |
| 3,745,593 | 7/1973 | Wall | 4/172.19 |

*Primary Examiner*—Henry K. Artis

[57] ABSTRACT

A pool framework made of sheet metal components can be readily erected and/or dismantled by unskilled labour without the use of fixings such as screws, bolts, rivets or welding. A series of flat, upwardly and outwardly sloping wall panels supported on a similar series of base beams form a closed polygon. Adjacent side edges of each pair of wall panels are interconnected by junction assemblies and are surmounted by a coping assembly forming a peripheral upper deck for the pool.

22 Claims, 20 Drawing Figures

PORTABLE SWIMMING POOL CONSTRUCTION

This invention relates to a portable swimming pool framework. In this connection, the term "portable" is intended to refer to the fact that the pool framework is of such a nature that it can be erected and/or dismantled with comparative ease, for example by an owner, without the assistance of heavy machinery, complex tools or specially trained personnel. The pool will normally be of the "above ground" type, although clearly a pool according to the invention could be located in a depression in the ground with its upper edge flush with a surrounding ground surface.

The primary object of the present invention is to provide a portable pool construction that can be readily erected and/or dismantled by unskilled labor and with only the use of normal household tools. There should be no requirement for such construction features as welding, rivetting or the like. Indeed, in the preferred embodiment of pool construction illustrated and described below, there are no bolts or screws employed whatsoever.

Another object of the invention is the provision of a structurally sound framework that will be rugged and durable, displaying resistance to distortion or the setting up of undesirable localized stresses arising from the very substantial forces to which any pool filled with water is subjected.

Other desirable features in a portable pool framework, which features are provided by the specific embodiment described below, are:

a. an absence of all forms of fastening devices of the bolt, screw and rivet variety;
b. a flexibility of design that enables the size of the pool to be enlarged by the addition of extra segments;
c. an ease of erection and dismantling, including dismantling into sections that are of a size convenient for storage or shipment;
d. a construction solely from sheet metal components, except for a plastic liner and any foundations required;
e. a pleasing asthetic appearance;
f. a design that is inherently susceptible to variations of shape in order to meet varying demands; and
g. a design that is capable of withstanding subfreezing winter temperatures without need for draining.

An embodiment of the invention is illustrated in the accompanying drawings. It is emphasized that this embodiment is shown by way of example only, and that the broad concepts of the invention are limited only by the appended claims.

Figure 15:
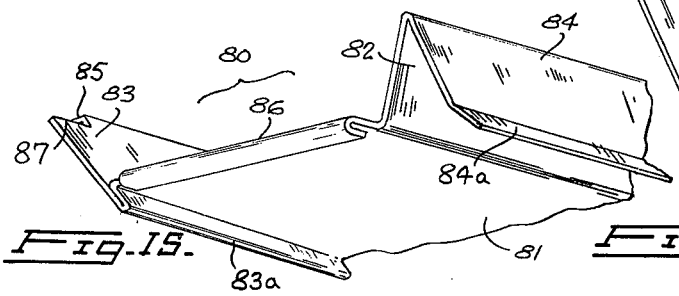
FIG. 15 is a similar view of a lower coping member used in the construction.
Figure 15A:
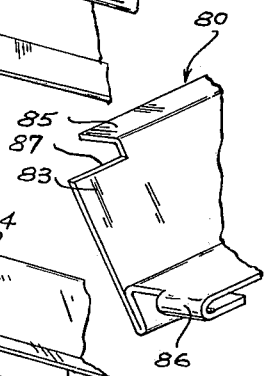
Figure 17:
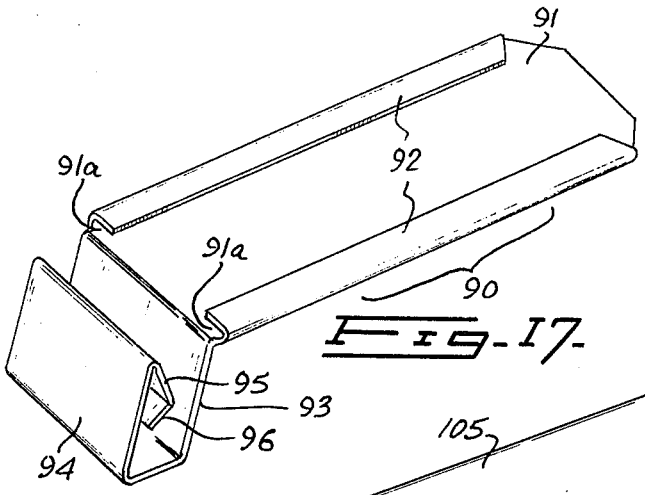
Figure 16:
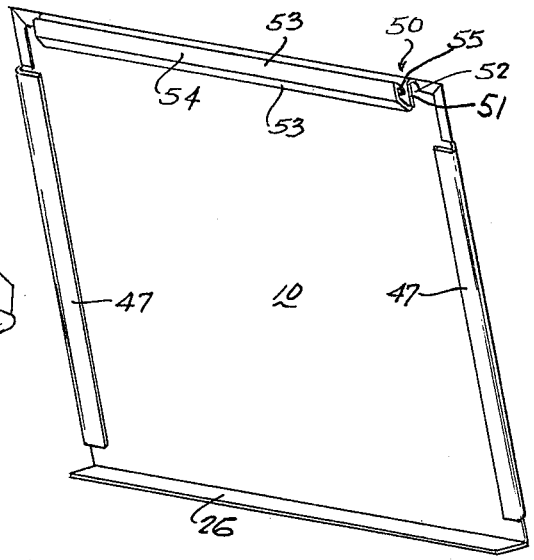
Figure 18:
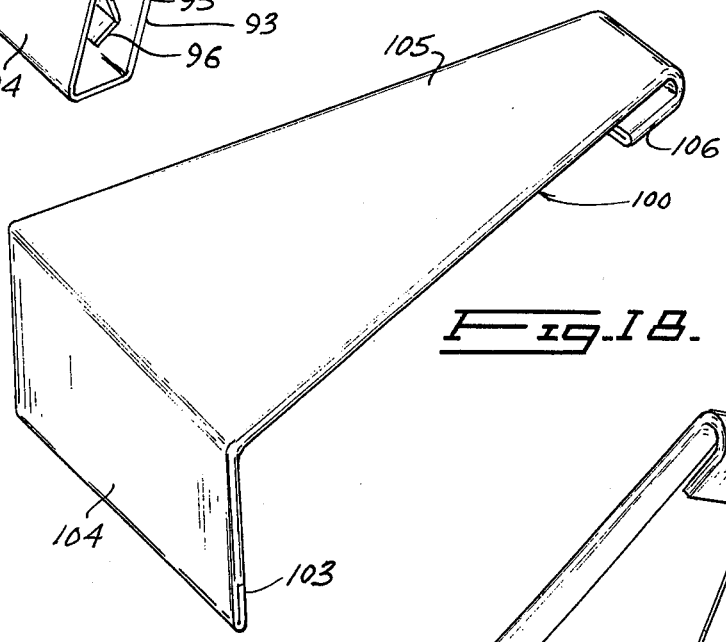

FIG. 15*a* is a fragmentary view of the left hand corner of FIG. 15 seen from above;

FIG. 16 is a perspective view of a wall panel;

FIG. 17 is a perspective view of a connector;

FIG. 18 is a perspective top view of a coping cap; and

Figure 19:
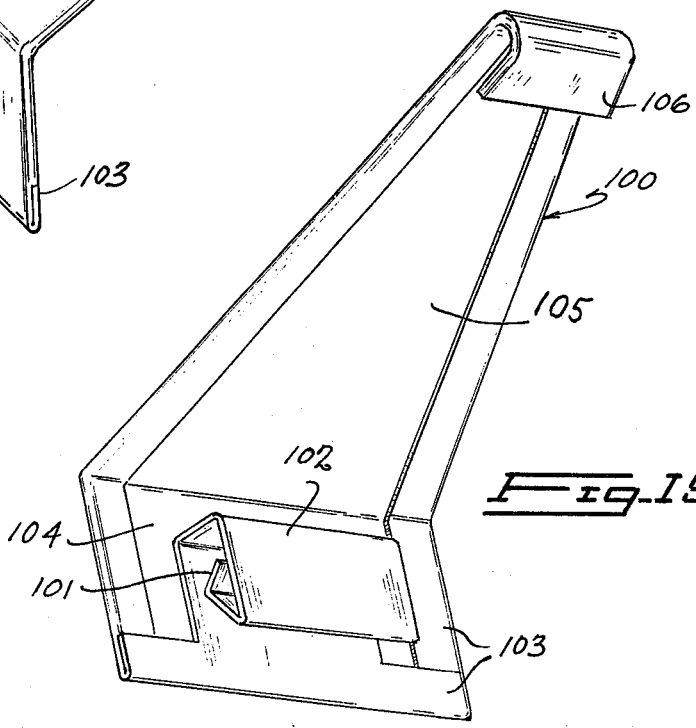

FIG. 19 is an underside perspective view of the coping cap of FIG. 18.

OVERALL CONSTRUCTION (FIGS. 1 TO 3).

Figure 1:
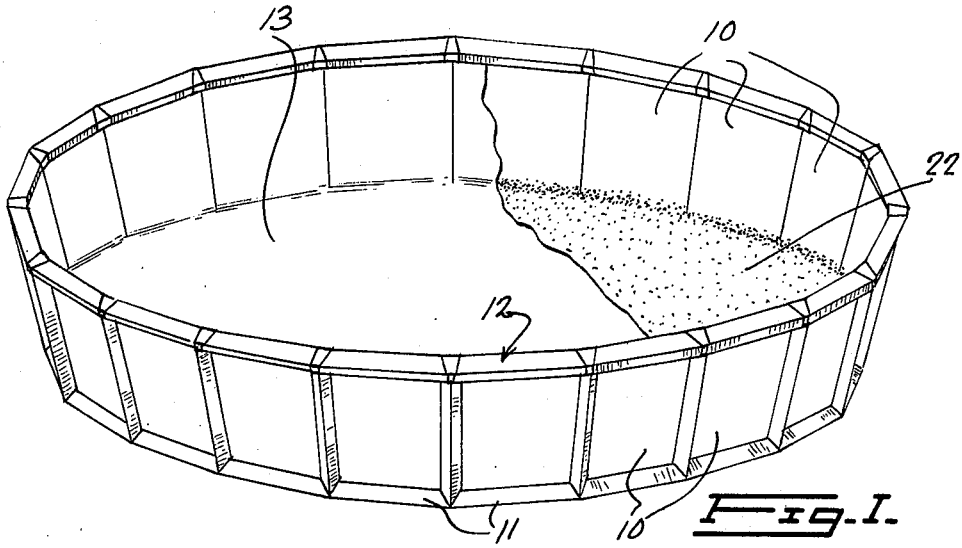
FIG. 1 is a relatively small scale, top perspective view of a pool embodying features of the invention, a portion of this view having been cut away to reveal otherwise hidden features.
Figure 2:
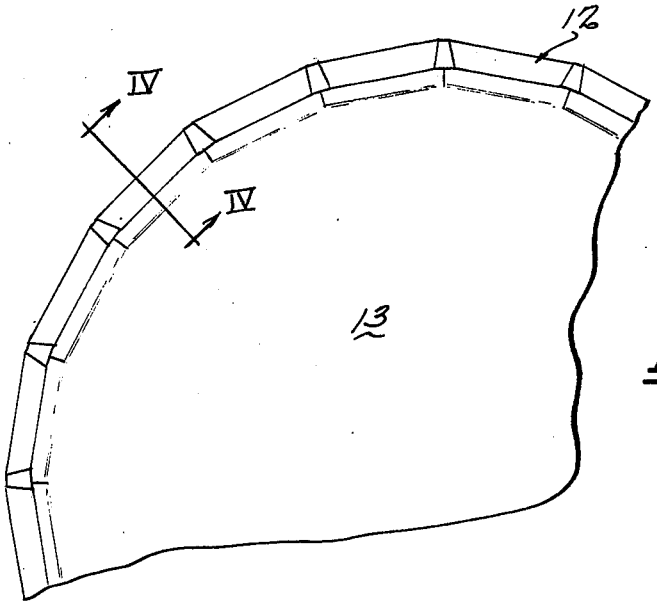
FIG. 2 is a fragmentary plan view of FIG. 1.
Figure 3:
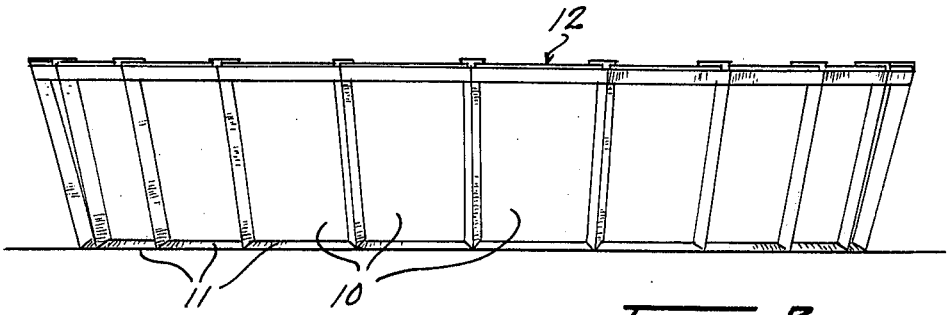
FIG. 3 is a side view of the pool of FIGS. 1 and 2.

Referring firstly to FIGS. 1 to 3, the pool framework will be seen to be essentially polygonal in shape and to consist of a series of flat, sheet metal wall panels 10 connected together at their side edges in a manner described in detail below. The wall panels slope upwardly and outwardly from a base beam assembly shown generally at 11 to a coping assembly shown generally at 12. A waterproof vinyl or similar liner 13 lines the interior of the metal framework formed by the wall panels 10 and their associated parts.

The outward slope given to the wall panels 10 prevents damage by ice in winter. In a pool subjected to sub-freezing temperatures ice will tend to form at the sides and on the top surface. Due to the relatively high thermal conductivity of the metal of the framework, most ice formation will take place at the sides. Ice formed down the sides will tend to rise, being lighter than water. Ice around the top edge and across the top may result in outward lateral expansion and can generate pressure sufficient to rupture the framework. The sloping sides of the present construction avoid this difficulty by virtue of the fact that ice formed encounters a greater pool diameter as it rises and hence has room for free expansion.

BASE BEAM ASSEMBLY (FIGS. 1, 4 AND 13)

Figure 4:
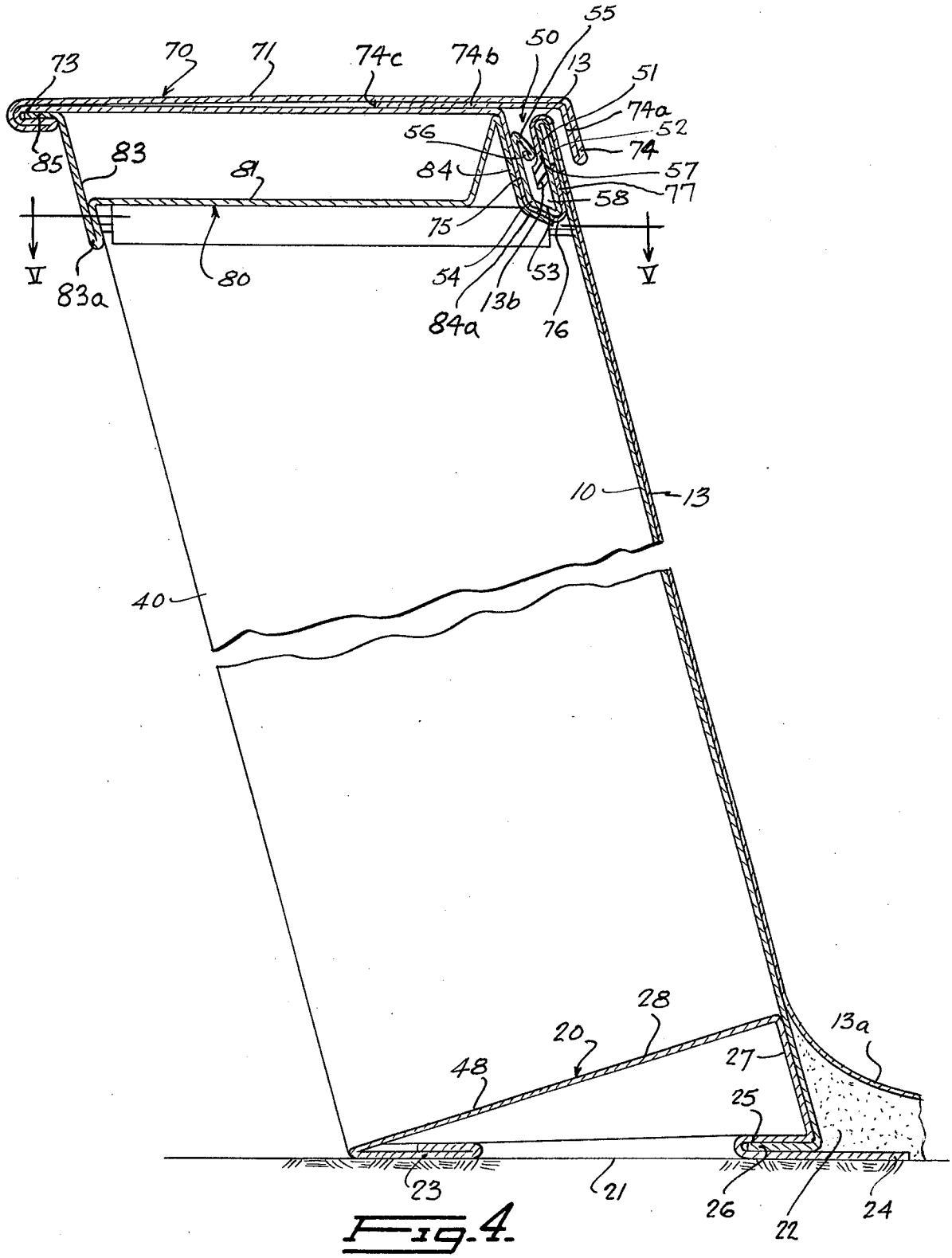
FIG. 4 is a section on an enlarged scale taken along the line IV—IV in FIG. 2.
Figure 13:
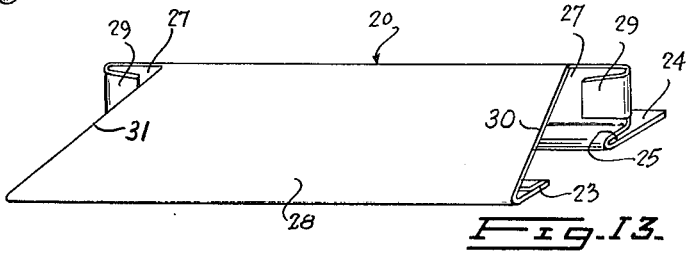
FIG. 13 is a perspective view of a base beam used in the construction.

The base beam assembly 11 is formed from a series of base beam members 20, one of which is shown individually in FIG. 13 and assembled with the other parts in FIG. 4. These base beams 20 which form the peripheral foundation for the structure can be placed directly on the ground, if this is sufficiently flat and hard. Alternatively, in a more permanent installation, or when the ground is insufficiently flat or hard, the beams 20 can be laid on a prepared concrete slab. Such a slab, if used, need not underlie the entire pool, but can take the form of an annulus supporting merely the base beam members 20. In FIG. 4, the base beam member is assumed to be seated on the ground or slab 21. The space within the closed polygon defined by the base beams 20 can be provided with a bed of sand 22 to form a convenient and non-injurious support for the central or horizontal portion 13*a* of the vinyl liner 13.

As clearly shown in FIG. 4, each base beam 20 consists of bent sheet metal formed with spaced-apart outer and inner foot portions 23 and 24. (References throughout to "inner" refer to parts nearer the interior, i.e., pool area defined by the polygonal framework, while references to "outer" refer to parts nearer the outer periphery of the assembly.) The inner foot portion 24 has an elongated slot 25 that receives a horizontal tongue 26 extending along the lower edge of the associated wall panel 10. The base beams 20 are each triangular in cross-section, having a wall 27 that slopes upwardly and outwardly contiguous with a lower surface of the wall panel 10 to support the same and prevent it from bowing outwardly, and a gently outwardly and downwardly sloping wall 28 which extends to the outer foot portion 23. As seen in FIG. 13 the ends of the wall 27 are formed with flanges 29 the purpose of which will be described below. The end edges 30, 31 of each base beam 20 are cut back for a purpose that will also become apparent.

JUNCTION ASSEMBLIES (FIGS. 5, 11, 12, 13 & 16)

Figure 11:
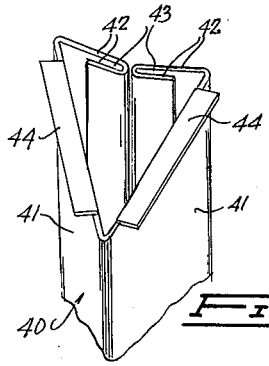
FIG. 11 is a top perspective view of a portion of a strut beam used in the construction.

The main member interconnecting each adjacent pair of side edges of the wall panels 10 to form a junction assembly is a strut beam member 40 which, as seen in FIG. 11, is a sheet metal member bent to an approximately triangular shape. Each member 40 has a pair of diverging side walls 41 each formed at its free end with an inwardly projecting flange 42 that is turned back on itself to form a slot 43. The upper edges of the side walls 41 are formed with outwardly projecting rectangular tongues 44.

Figure 12:
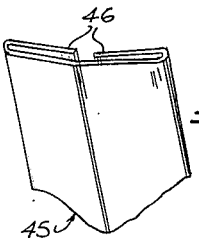
FIG. 12 is a similar fragmentary top perspective view of a strut beam cleat used in the construction.

Associated with each strut beam 40 is a strut beam cleat member 45 (FIG. 12) which is essentially an elongated sheet metal member bent to form inturned flanges 46.

Figure 5:
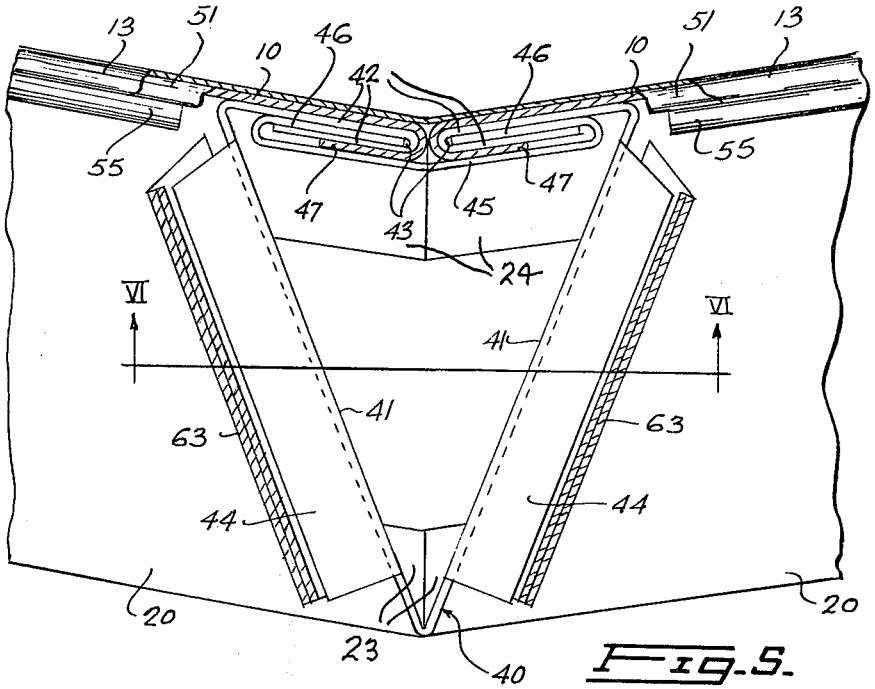
FIG. 5 is a view taken on the plane V—V in FIGS. 4 and 6.

As best seen in FIG. 5, the strut beam 40 and the strut beam cleat 45 serve to interconnect adjacent wall edges of a pair of wall panels 10 to form a junction assembly. Each side edge of the wall panels 10 is formed with a flange 47 (FIG. 16) defining a slot into which a respective one of the turned-back flanges 42 of the strut beam 40 is inserted. A flange 46 of the strut beam cleat 45 is then introduced into each slot 43 formed within each flange 42 whereby to expand the parts thereof firmly outwardly against the surfaces of the wall panel 10 and its associated flange 47. These parts are assembled by longitudinal insertion one into the other from the top: first the strut beam 40 is moved downwardly with its flanges 42 between the wall panels and their associated flanges 47. The strut beam cleat 45 is then introduced longitudinally down into this assembly and driven firmly into position.

The flanges 29 of the base beams 20, as best seen in FIG. 13, act as extensions of the flanges 47 of the wall panels 10, the lower ends of the strut beam 40 and the cleat 45 extending down into a similar engagement with the flanges 29 thus joining the base beams 20 end-for-end at the same time as joining the wall panels side-to-side. The downward limit of travel of the strut beam 40 and cleat 45 is determined by these parts engaging the foot portions 23 & 24 of the base beams 20. The cutting back of the edges 30, 31 (FIG. 13) permits the side walls 41 to fit snuggly in the triangular space defined by these edges. This fit prevents spreading apart of the lower ends of the walls 41.

The resulting junction assembly is an especially satisfactory one from the viewpoint of symmetrically resisting the outward loads exerted on the wall panels by the water in the pool. At the same time it is essentially simple to assemble and disassemble.

LINER SECURING (FIGS. 4 & 16)

As appears from FIGS. 16 and 4, each wall panel 10 is formed at its upper edge with a multiply-bent flange construction 50 that consists of a first flange portion 51 defining an upwardly projecting slot 52 between itself and the wall panel 10, and a second flange portion 53 extending outwardly and upwardly from the bottom edge of the flange portion 51 and into a third flange portion 54 projecting upwardly parallel to the wall panel 10. This third portion 54 in turn extends into a downwardly projecting fourth flange portion 55 that is bent over again at its edge 56. The first and fourth flange portions 51, 55 define between them an upwardly facing slot consisting of a narrow neck 57 that widens into a larger space 58. The vinyl liner 13 is formed with an edge bead **13*b* wider than the neck 57, such bead being forced, by springing the metal, through the neck 57 into the space 58** to be retained therein.

LOCKING MEMBER (FIGS. 5, 6, 8, 9 & 10)

Figure 8:
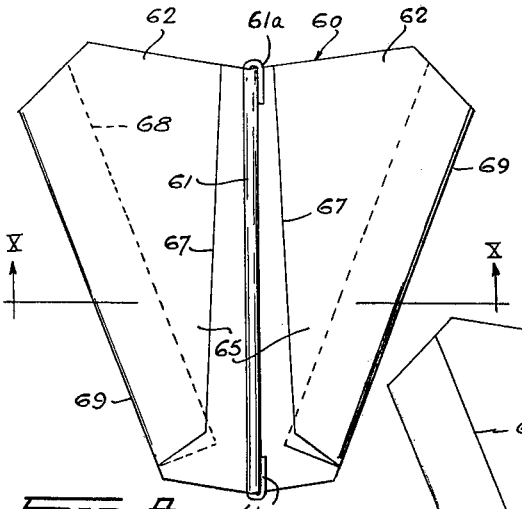
FIG. 8 is a top plan view of a locking member employed in the construction of FIGS. 1 to 7.
Figure 10:
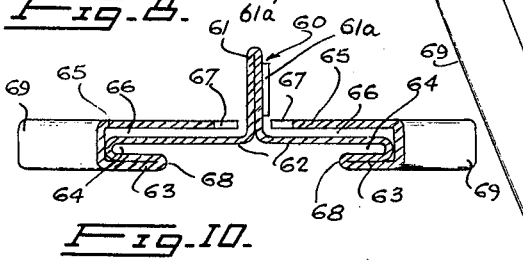
FIG. 10 is a section on the line X—X in FIG. 8.
Figure 9:
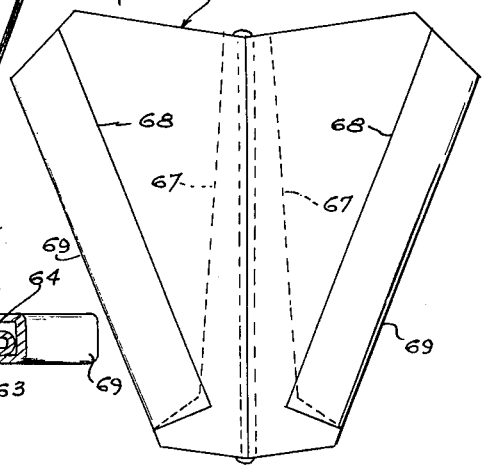
FIG. 9 is an underside view of the locking member of FIG. 8.

Referring again to FIG. 5, force experienced by a strut beam 40 tending to spread its side walls 41 apart is resisted at the upper end of such beam by the engagement over its upper edges of a locking member 60 shown in FIGS. 8, 9 and 10. This locking member 60 is also formed of sheet metal and consists of a central spine 61 with turned over ends **61*a* and a pair of triangular wing portions 62 bent to form underside turned-back flanges 63 defining slots 64 and upper turned-back flanges 65 defining upper slots 66 with the main wing portions 62. The upper flanges 65 have edges 67 extending substantially parallel to the spine 61, whereas the underside flanges 63 have edges 68 extending substantially parallel to the outer edges 69, such edges 69 diverging from the spine 61** and from each other.

Figure 6:
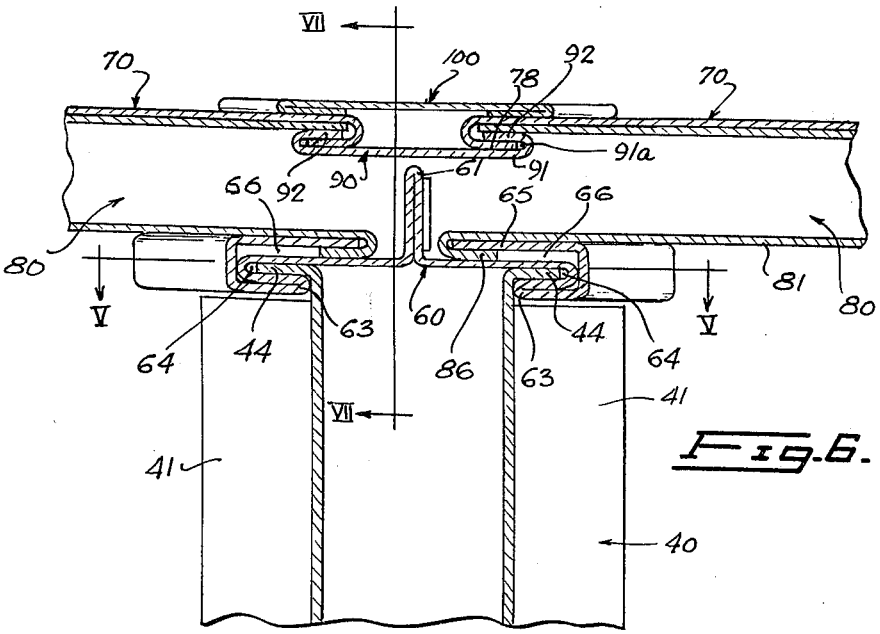
FIG. 6 is a section on the line VI—VI in FIG. 5.

One locking member 60 is slid over the top of each strut beam 40, in the manner best seen in FIG. 6, the upper tongues 44 of the strut beam 40 occupying the underside slots 64 of the member 60, these underside locking flanges 63 having basically a similar shape and orientation to that of the tongues 44.

COPING ASSEMBLY (FIGS. 4, 6, 14, 15 & 15*a*)

Figure 14:
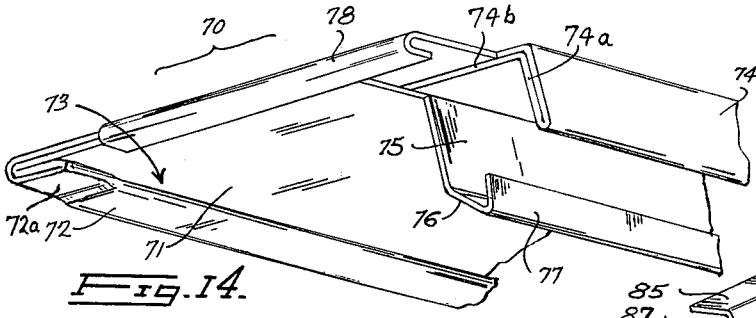
FIG. 14 is a fragmentary, end perspective view of an upper coping member used in the construction.

The structure is now ready for erection of the upper and lower coping members 70 and 80 shown individually in FIGS. 14 and 15 respectively.

The upper coping member 70 consists of sheet metal bent to provide a double layer, main horizontal panel 71 formed along one edge with a bent-back flange 72 defining a slot 73. Along its opposite edge the upper layer of the member 70 is bent downwardly to form a vertical wall 74, the metal being further bent back at **74*a* and 74*b* to terminate at 74*c* between the two layers of the panel 71 (see FIG. 4). Outwardly of the wall 74, 74*a* the lower layer of the member 70 is bent down to form a flange having successive portions 75, 76, 77. Turned around lips 78 are provided along each side edge of the member 70**.

As seen in FIG. 4, when the member 70 is in position, the flange portions 75 to 77 embrace the portions 54, 53 and 51 respectively of the flange 50 of the wall panel 10, the flange portion 77 engaging in the upwardly projecting slot 52 between the flange portion 51 and the panel 10 itself, whereby to hold the inner edge of the coping member 70 firmly in position against upward movement. The lower edge of the vertical wall 74 either can rest gently against the liner 13 or can be slightly spaced therefrom as shown. In either case, such wall 74 provides a finished edge and appearance to the inside upper perimeter of the coping assembly of the pool.

Next in the assembly process, the lower coping member 80 is introduced. As FIG. 15 shows, this member consists of a main panel 81 with up-turned walls 82, 83 inner and outer. The inner wall 82 terminates in a bent-over flange 84 further bent at 84*a*, while the outer wall 83 terminates in a horizontal flange 85 (FIG. 15*a*). A portion of the wall and flange is cut out at each end, as shown at 87. Bent-around lips 86 are provided along each side edge, and the wall 83 has a downward extension 83*a*.

When inserted from left to right in FIG. 4 beneath the upper coping member 70, the lower member 80 engages the flange portions 75, 76 with its flange portions 84, 84*a*. The main panel 81 of the member 80 rests at each end on the upper surface of a locking member 60, as best seen in FIG. 6, its edge lips 86 each sliding into one of the upper slots 66 of such locking member. Finally, the lower member 80 is sprung into a locked position beneath the upper member 70 by engagement of its rear flange 85 into the slot 73 (FIG. 4).

CONNECTOR AND COPING CAP (FIGS. 6, 7, 17, 18 & 19)

Figure 7:
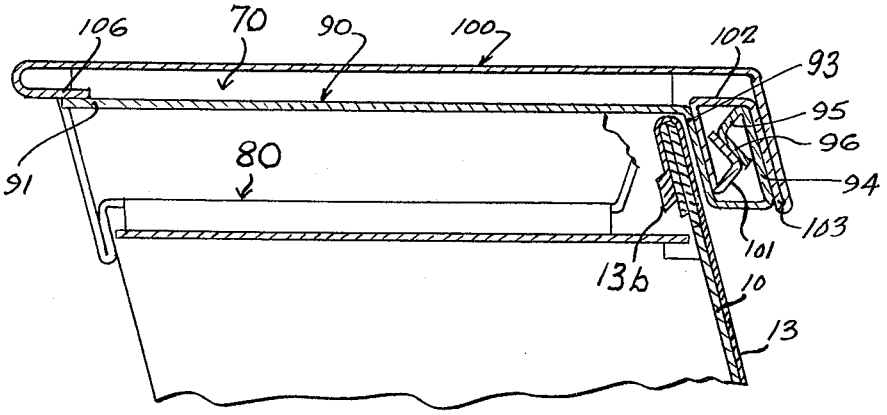
FIG. 7 is a view on the line VII—VII in FIG. 6.

The assembly is completed by a connector 90 and a coping cap 100, shown individually in FIG. 17 and FIGS. 18 and 19 respectively. The connector 90 has a main panel 91 with turned-back edge flanges 92 that engage the bent-over lips 78 (FIG. 6) when the connector is slid into place to connect a pair of upper coping members 70. This sliding movement takes place from inside to outside, i.e., from right to left in FIG. 7, the connector 90 having at its inner end a multiply-bent flange having main portions 93, 94 & 95. The flange portion 95 includes an angulated extension 96 which, together with the flange portion 93 defines a locking space into which there is introduced a similar angulated flange 101 formed on the end of a multiply-bent flange structure 102 provided centrally of the inner surface of the coping cap 100, as shown in FIG. 19. This flange structure forms an extension of a bent over portion 103 of an inner vertical wall 104 extending down from the main panel 105 of the coping cap 100. This locking flange arrangement (95, 96, 101) is brought together by forcing the coping cap 100 downwardly onto the assembly, after first engaging a turned-around lip 106 at the other end of such cap around and underneath the two coping members 70 and above the rear end of the main panel 91 of the connector 90. Space for the lip is provided be means of a recess 72*a* formed at each end of the flange 72 of the upper coping member 70 (FIG. 14) by crimping together of the panel 71 and flange 72 to close the slot 73, and by the cutout portions 87 of the lower coping member 80 (FIGS. 15, 15*a*).

We claim:

1. In a portable swimming pool framework having a plurality of sheet metal members arranged side-by-side, a junction assembly for interconnecting adjacent edges of a pair of said members, said junction assembly comprising:

a. a first pair of turned-back flanges formed along respective ones of said edges to define a first pair of slots facing away from each other, b. a beam member having a wall structure interconnecting a second pair of elongated flanges projecting generally towards each other and then each turned back on itself to define a second pair of slots, c. said second pair of flanges being located in respective ones of said first pair of slots, d. and a cleat member having a wall structure interconnecting a third pair of flanges projecting generally towards each other, e. said third pair of flanges being located in respective ones of said second pair of slots.

2. The invention of claim 1, wherein said members are wall panels defining a wall structure of the framework.

3. The invention of claim 1, wherein said members are elongated base beams each for supporting a wall panel of the framework.

4. The invention of claim 1, f. wherein said members include wall panels defining a wall structure of the framework and elongated base beams each supporting a said wall panel, g. the same beam member and the same cleat member simultaneously serving to form a junction assembly interconnecting adjacent edges of both a pair of said wall panels and a pair of said base beams.

5. The invention of claim 1, wherein said wall structure of the beam member comprises a pair of side walls diverging from each other and terminating in said second pair of flanges.

6. The invention of claim 5, including a locking member having locking portions engaging said side walls of the beam member to clamp the same together and inhibit spreading apart of said second pair of flanges.

7. The invention of claim 6, wherein said locking member is generally triangular in shape, said locking portions thereof comprising underside inturned flanges extending along divergent edges of the locking member, such underside flanges engaging complementary outwardly extending tongues extending along upper edges of said side walls of the beam member.

8. The invention of claim 4, h. wherein said wall structure of the beam member comprises a pair of side walls diverging from each other and terminating in said second pair of flanges, i. including a locking member having locking portions engaging said side walls of the beam member to clamp the same together and inhibit spreading apart of said second pair of flanges, j. said locking member being located at an upper end of the beam member, k. said base beams having surfaces engaging said side walls of the beam member at a lower end thereof for inhibiting spreading apart of said second pair of flanges.

9. A portable swimming pool framework comprising a plurality of flat sheet metal panels arranged side-by-side and interconnected to form a closed polygon, wherein each such panel is inclined upwardly and outwardly of such polygon.

10. A framework according to claim 9, including a base beam for supporting each said wall panel, each base beam comprising:

a. a sheet metal structure of generally triangular form terminating in inner and outer spaced-apart foot portions, b. the inner one of said foot portions defining an elongated horizontal slot receiving an elongated horizontal tongue formed along a bottom edge of said wall panel.

11. A framework according to claim 10, including a junction assembly interconnecting each pair of adjacent side edges of said wall panels and each pair of adjacent ends of said base beams; each said junction assembly comprising:

c. first pairs of turned-back flanges formed along respective ones of said side edges and ends to define first pairs of slots facing away from each other, d. a beam member having a wall structure interconnecting a second pair of elongated flanges projecting generally towards each other and then each turned back on itself to define a second pair of slots, e. said second pair of flanges being located in respective ones of said first pairs of slots, f. and a cleat member having a wall structure interconnecting a third pair of flanges projecting generally towards each other, g. said third pair of flanges being located in respective ones of said second pair of slots.

12. In a portable swimming pool:

a. a plurality of sheet metal wall panels arranged side-by-side to define a wall structure;

b. a plurality of base beams each supporting a respective one of said wall panels; and c. a plurality of junction assemblies interconnecting each adjacent pair of side edges of said wall panels and each adjacent pair of ends of said base beams to form a closed polygonal framework defining a pool area;

d. each said junction assembly comprising i. first pairs of turned-back flanges formed along respective ones of said side edges and ends to define first pairs of slots facing away from each other, ii. a beam member having a wall structure interconnecting a second pair of elongated flanges projecting generally towards each other and then each turned back on itself to define a second pair of slots, iii. said second pair of flanges being located in respective ones of said first pairs of slots, iv. and a cleat member having a wall structure interconnecting a third pair of flanges projecting generally towards each other, v. said third pair of flanges being located each in respective ones of said second pair of slots.

13. The invention of claim 12, wherein said wall structure of the beam member comprises a pair of side walls diverging from each other and terminating in said second pair of flanges.

14. The invention of claim 13, including a locking member having locking portions engaging said side walls of the beam member to clamp the same together and inhibit spreading apart of said second pair of flanges.

15. The invention of claim 14, e. wherein said locking member is generally triangular in shape, said locking portions thereof comprising underside inturned flanges extending along divergent edges of the locking member, such underside flanges engaging complementary outwardly extending tongues extending along upper edges of said side walls of the beam member, f. said base beams having surfaces engaging said side walls of each beam member at a lower end thereof for further inhibiting spreading apart of said second pair of flanges.

16. The invention of claim 12, including e. a plurality of elongated, sheet metal, upper coping members located one above each said wall panel to form a peripheral deck around the framework, and f. a corresponding plurality of elongated, sheet metal, lower coping members located one below each upper coping member to support such upper coping member, g. said lower coping members having end surfaces supported on respective ones of said junction assemblies.

17. The invention of claim 15, wherein each said locking member has upper, turned-back, edge flanges, and including g. a plurality of elongated, sheet metal, upper coping members located one above each said wall panel to form a peripheral deck around the framework, and h. a corresponding plurality of elongated, sheet metal, lower coping members located one below each upper coping member to support such upper coping member, i. each said lower coping member having turned-back end flanges engaging the locking member upper flanges for preventing movement of said junction assemblies away from each other and for supporting said lower coping member.

18. The invention of claim 17, including j. a plurality of connectors each having turned-back flanges, k. each said upper coping member having turned-back end flanges engaging said connector flanges for preventing peripheral movement of said upper coping members relative to each other.

19. A portable swimming pool comprising a. a plurality of sheet metal wall panels arranged side-by-side to define a wall structure;

b. a plurality of base beams each supporting a respective one of said wall panels; and c. a plurality of junction assemblies interconnecting each adjacent pair of side edges of said wall panels and each adjacent pair of ends of said base beams to form a closed polygonal framework defining a pool area;

d. each said junction assembly comprising i. first pairs of turned-back flanges formed along respective ones of said side edges and ends to define first pairs of slots facing away from each other, ii. a beam member having a wall structure interconnecting a second pair of elongated flanges projecting generally towards each other and then each turned back on itself to define a second pair of slots, iii. said second pair of flanges being located in respective ones of said first pairs of slots, iv. and a cleat member having a wall structure interconnecting a third pair of flanges projecting generally towards each other, v. said third pair of flanges being located each in respective ones of said second pair of slots, e. a plurality of locking members each engaging an upper part of a said beam member to inhibit spreading apart of said second pair of flanges, f. said base beams having surfaces engaging a lower part of each beam member further to inhibit such spreading, g. each said wall panel terminating along an upper edge thereof in a flange construction defining a downwardly projecting slot extending along said upper edge on a side thereof outwardly of said pool area, h. said slot having a main portion and a neck portion narrower than said main portion and located thereabove, i. a water-proof liner lining said pool area, said liner extending up said wall panels and around the upper edges thereof and down into said slots, said liner being formed with a peripheral bead extending along said slots and having a width greater than said necks whereby to retain the bead in the main portions of said slots, j. a plurality of elongated, sheet metal, upper coping members located one above each said wall panel to form a peripheral deck around the framework, k. a corresponding plurality of elongated, sheet metal, lower coping members located one below each upper coping member to support such upper coping member, l. each said lower coping member having turned-back end flanges engaging the locking member upper flanges for preventing movement of said junction assemblies away from each other and for supporting said lower coping member, m. a plurality of connectors each having turned-back flanges, n. each said upper coping member having turned-back end flanges engaging said connector flanges for preventing peripheral movement of said upper coping members relative to each other, o. each lower coping member comprising a horizontal panel extending into up-turned walls along inner and outer edges thereof, p. the inner one of said up-turned walls extending into a downwardly projecting flange engaging a downwardly extending inner wall of the corresponding upper coping member, q. the outer one of said up-turned walls extending into a horizontally projecting flange engaged in a slot formed by a turned-back flange at an outer edge of said corresponding upper coping member, r. each said flange construction of the wall panels defining an upwardly projecting slot between such flange construction and an outer face of the wall panel, and s. the downwardly extending inner wall of each said upper coping member extending into an upwardly projecting flange engaging in the last-mentioned slot to hold the inner edge of such upper coping member against upward movement.

20. In a portable swimming pool construction a. a plurality of sheet metal wall panels arranged side-by-side to define a wall structure, b. a plurality of junction assemblies interconnecting each adjacent pair of side edges of said wall panels to form a closed polygonal framework, c. a plurality of elongated, sheet metal, upper coping members located one above each said wall panel to form a peripheral deck around the framework, d. a plurality of connectors interconnecting each adjacent pair of ends of said coping members, e. a corresponding plurality of elongated, sheet metal, lower coping members located one below each upper coping member to support such upper coping member, f. a plurality of locking members interconnecting each adjacent pair of ends of said lower coping members, g. wherein each said junction assembly comprises 1. a first pair of turned-back flanges formed along respective ones of said side edges to define a first pair of slots facing away from each other, 2. a beam member having a wall structure interconnecting a second pair of elongated flanges projecting generally towards each other and then each turned back on itself to define a second pair of slots, 3. said second pair of flanges being located in respective ones of said first pair of slots, 4. and a cleat member having a wall structure interconnecting a third pair of flanges projecting generally towards each other, 5. said third pair of flanges being located in respective ones of said second pair of slots, 6. each said locking member further engaging side walls of the beam member to inhibit spreading apart of said second pair of flanges.

21. In a portable swimming pool construction a. a plurality of sheet metal wall panels arranged side-by-side to define a wall structure, b. a plurality of junction assemblies interconnecting each adjacent pair of side edges of said wall panels to form a closed polygonal framework, c. a plurality of elongated, sheet metal, coping members located one above each said wall panel to form a peripheral deck around the framework, said coping members having bent-back ends, d. a plurality of connectors with turned-back edge flanges each slidingly engaging a pair of adjacent bent-back ends of said coping members for firmly interconnecting each adjacent pair of ends of said coping members, and e. a plurality of coping caps each located above a respective connector and engaging adjacent ends of a pair of said coping members to provide continuity of said peripheral deck, f. each coping cap having a turned-back lip at one end for engaging under said adjacent coping member ends and a first locking assembly at its other end engaging a second locking assembly of a connector, said locking assemblies each comprising a resilient flange structure for firm snap-on engagement with each other.

22. The invention of claim 21, wherein each said junction assembly comprises g. a first pair of turned-back flanges formed along respective ones of said side edges of said wall panels to define a pair of slots facing away from each other, and h. a beam member having a wall structure interconnecting a pair of elongated flanges projecting generally towards each other and located in respective ones of said slots, and wherein i. said coping members are upper coping members, j. including a corresponding plurality of elongated, sheet metal, lower coping members locating one below each upper coping member to support such upper coping member, said lower coping members having bent-back ends, and k. a plurality of locking members having on their upper sides turned-back edge flanges each slidingly engaging a pair of adjacent bent-back ends of said lower coping members for firmly interconnecting each adjacent pair of said lower coping members, l. each said locking member also having on its lower side a further pair of turned-back edge flanges slidingly engaging a pair of tongues formed on a said beam member to inhibit spreading apart of said flanges of said beam member.

* * * * *